US008091867B2

(12) United States Patent
Kikuchi et al.

(10) Patent No.: US 8,091,867 B2
(45) Date of Patent: Jan. 10, 2012

(54) APPARATUS FOR PRODUCING MICROBUBBLE LIQUID AND DEVICE FOR ATOMIZING AIR BUBBLES USING THE SAME

(75) Inventors: Takashige Kikuchi, Kita-ku (JP); Kazumi Ishihara, Kita-ku (JP)

(73) Assignee: Kikuchi Eco-Earth Co., Ltd, Tokyo (JP)

( * ) Notice: Subject to any disclaimer, the term of this patent is extended or adjusted under 35 U.S.C. 154(b) by 987 days.

(21) Appl. No.: 11/991,149

(22) PCT Filed: Aug. 31, 2005

(86) PCT No.: PCT/JP2005/015866
§ 371 (c)(1),
(2), (4) Date: Feb. 28, 2008

(87) PCT Pub. No.: WO2006/033221
PCT Pub. Date: Mar. 30, 2006

(65) Prior Publication Data

US 2009/0051056 A1 Feb. 26, 2009

(51) Int. Cl.
*B01F 3/04* (2006.01)
*B01F 5/06* (2006.01)

(52) U.S. Cl. ..... 261/78.2; 261/DIG. 56

(58) Field of Classification Search ..... 239/419.5; 261/34.1, 78.2, DIG. 55, DIG. 56; 210/758, 210/628, 150
See application file for complete search history.

(56) References Cited

U.S. PATENT DOCUMENTS

| | | | | |
|---|---|---|---|---|
| 4,721,562 | A | 1/1988 | Barnscheidt et al. | |
| 5,061,406 | A * | 10/1991 | Cheng | 261/76 |
| 7,571,899 | B2 * | 8/2009 | Kitasako et al. | 261/29 |

FOREIGN PATENT DOCUMENTS

| | | |
|---|---|---|
| JP | 61-501716 | 8/1986 |
| JP | 2004-267868 | 9/2004 |
| JP | 2005-28305 | 2/2005 |
| JP | 2005-95877 | 4/2005 |

OTHER PUBLICATIONS

Machine generated English translation of JP 2005-028305, published Feb. 3, 2005.*
International Search Report issued Dec. 13, 2005 in the International (PCT) Application of which the present application is the U.S. National Stage.

* cited by examiner

*Primary Examiner* — Frank Lawrence, Jr.
(74) *Attorney, Agent, or Firm* — Wenderoth, Lind & Ponack, L.L.P.

(57) ABSTRACT

In a microbubble liquid producing apparatus, an air bubble liquid producing device for mixing liquid with air by an aspirating pressure generated by a pressure pump arranged on a liquid feeding pipeline while aspirating the liquid from a liquid supply source and forcibly feeding the liquid by pressure is disposed on the liquid feeding pipeline on the upstream side of the pressure pump relative to the liquid feeding direction. A first air-bubble atomizer is disposed on the liquid feeding pipeline on the downstream side of the air bubble liquid producing device for atomizing the air bubbles contained in the air-mixed liquid produced by the air bubble liquid producing device. A second air-bubble atomizer is disposed on the liquid feeding pipeline on the downstream side of the first air-bubble atomizer for further atomizing the air bubbles atomized by the first air-bubble atomizer.

12 Claims, 11 Drawing Sheets

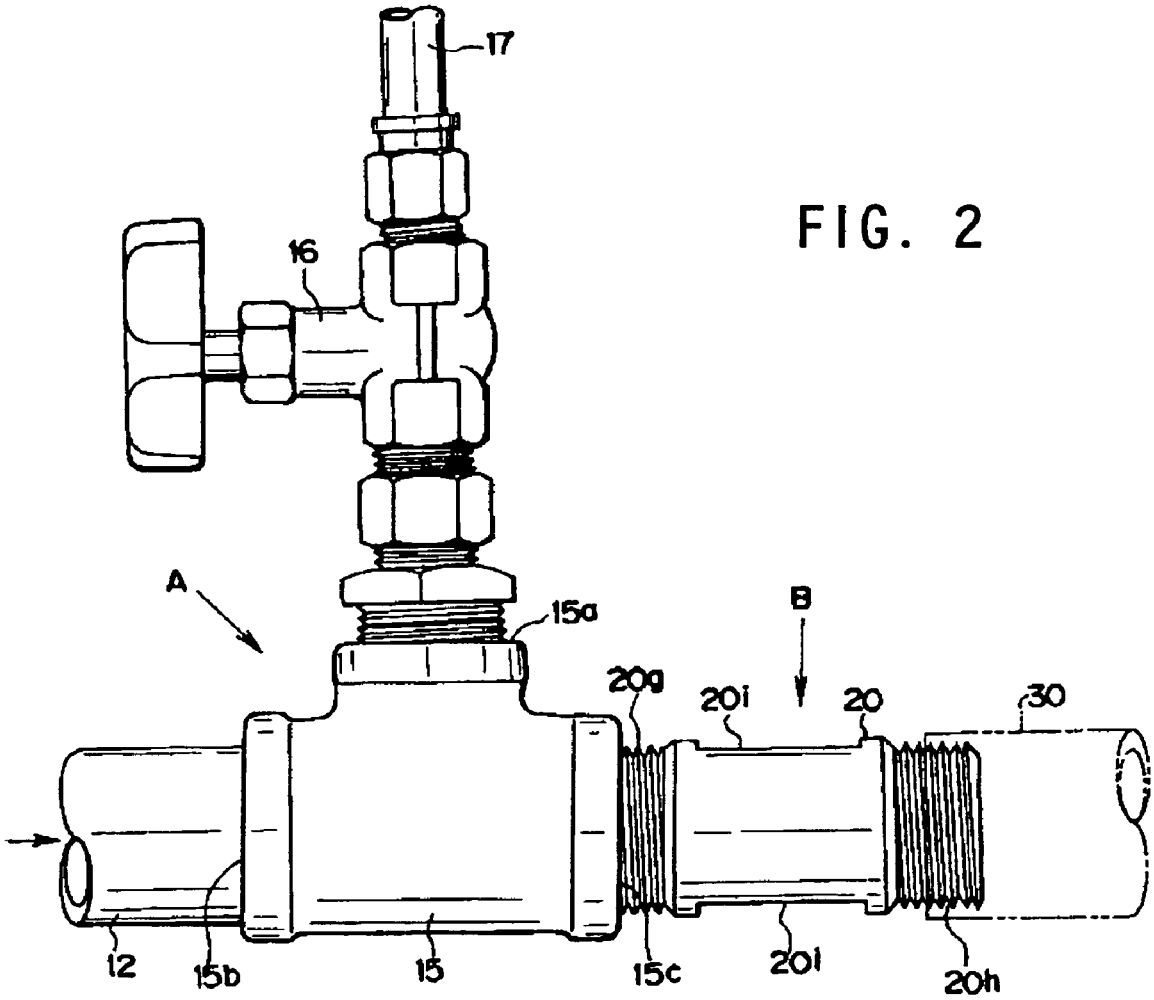
FIG. 2
FIG. 3
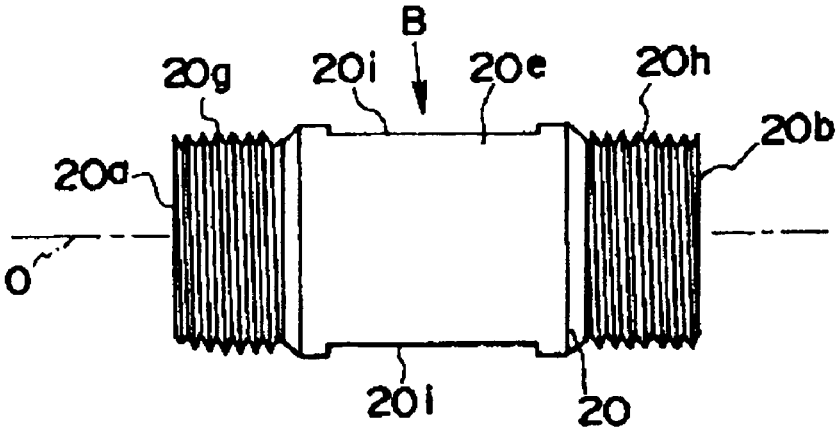

APPARATUS FOR PRODUCING MICROBUBBLE LIQUID AND DEVICE FOR ATOMIZING AIR BUBBLES USING THE SAME

TECHNICAL FIELD

This invention relates to an apparatus for producing microbubble liquid used for treatment for separating lipids contained in waste liquid, surplus sludge treatment and so forth and a device for atomizing air bubbles for use in the same.

BACKGROUND ART

A conventional microbubble-liquid producing apparatus of this type is disclosed in, for instance, Japanese Published Unexamined Application No. 2003-117365(A). The conventional microbubble-liquid producing apparatus comprises an air-liquid mixing pump for aspirating mixture fluid of liquid and air, a resistor for imposing resistance to fluid discharged from the air-liquid mixing pump, and an inverter for controlling the rotation speed of the air-liquid mixing pump, wherein an annular fluid passage having a narrow radial width is formed in a casing of the air-liquid mixing pump and many stirring blades protruding into the fluid passage are formed on the periphery of a bladed wheel.

[Patent Literature 1] Japanese Published Unexamined Application No. 2003-117365

However, the aforementioned conventional microbubble-liquid producing apparatus is designed to produce desired air microbubbles at a given time by using the single air-liquid mixing pump. For that purpose, the conventional apparatus has a need to assume its complicated structure comprising the annular fluid passage having the narrow radial width inside the casing and a number of stirring blades protruding into the fluid passage on the periphery of a bladed wheel.

Furthermore, the conventional apparatus requires the inverter for accurately controlling the rotation speed of the air-liquid mixing pump, inevitably to increase its production cost. Besides, in order to perform maintenance and inspection on the air-liquid mixing pump and other components, the complicated and specific structure of the apparatus should be totally known, but at any rate, the maintenance and inspection cannot be performed easily.

The present invention seeks to provide an apparatus for producing microbubble liquid, having a simplified structure to be produced at a moderate price and capable of being maintained and inspected with ease, and further having an advantage of capable of effectively producing microbubble liquid containing fully microscopic air bubbles, and further provide a device for atomizing air bubbles using the aforementioned apparatus.

SUMMARY OF THE INVENTION

Effect of the Invention

To attain the aforementioned object according to a first aspect of the present invention, there is provided an apparatus for producing a microbubble liquid containing microscopic gas bubbles, comprising a pressure pump arranged on a liquid feeding pipeline for aspirating liquid from a liquid supply source and forcibly feeding the liquid by pressure, an air bubble liquid producing means disposed on the liquid feeding pipeline on the upstream side of the air bubble liquid producing means relative to the liquid feeding direction for producing the air bubble liquid by mixing the liquid with air by an aspirating pressure generated by the aforementioned pressure pump, a first air-bubble atomizer disposed on the liquid feeding pipeline on the downstream side of the air bubble liquid producing means relative to the liquid feeding direction for atomizing the air bubbles contained in the air-mixed liquid produced by the air bubble liquid producing means, and a second air-bubble atomizer disposed on the liquid feeding pipeline on the downstream side of the first air-bubble atomizer relative to the liquid feeding direction for further atomizing the air bubbles atomized by the first air-bubble atomizer.

According to the apparatus described above, the air bubble liquid is produced by mixing the liquid supplied from the liquid supply source by the aspirating pressure generated by the pressure pump with the air in the air bubble liquid producing means, and then, forcibly fed sequentially to the first air-bubble atomizer and the second air-bubble atomizer, thereby to gradually atomize the air bubbles into finer size bubbles.

The device for atomizing air bubbles according to the invention to attain the aforementioned object includes an upstream-side bubble liquid passage having a certain cross section over a prescribed range along the liquid feeding pipeline, and a downstream-side bubble liquid passage provided on the downstream side and having a cross section gradually widening from the upstream side toward the downstream side relative to the liquid feeding direction.

According to this formation of the invention, the air bubble liquid undergoes a pressure change while flowing from the upstream-side bubble liquid passage to the downstream-side bubble liquid passage, consequently to atomize the air bubbles contained in the liquid into even smaller bubbles.

According to the invention, the air bubble liquid is produced by mixing the liquid supplied from the liquid supply source with air in the air bubble liquid producing means and forcibly fed to the first air-bubble atomizer and further to the second air-bubble atomizer in sequence so as to atomize the air bubbles in the air bubble liquid into finer size bubbles progressively.

Since the air bubbles in the air bubble liquid are progressively atomize into finer size bubbles by the first and second air-bubble atomizers, the component elements of the atomizers can be simplified. Consequently, a system including the microbubble liquid producing apparatus with the air-bubble atomizers can be manufactured at a moderate cost while maintenance and checks of the system can be performed with ease.

The present invention as set forth in the claims has the following effects in addition to the aforementioned common effects.

According to a second aspect of the invention, there is provided an apparatus for producing microbubble liquid, wherein the first air-bubble atomizer is arranged between the aforesaid air bubble liquid producing means and the pressure pump as described in the first aspect of the invention, and the second air-bubble atomizer is mounted on the liquid feeding pipeline on the downstream side in the liquid feeding direction of the pressure pump, thereby to actuate the air bubble liquid producing means by the aspirating pressure generated by the pressure pump and actuate the second air-bubble atomizer by the discharging pressure of the pressure pump. Consequently, the apparatus of the invention can be simplified.

According to a third aspect of the invention, there is provided an apparatus for producing microbubble liquid, wherein a pressure stabilizing tank is disposed on the liquid feeding pipeline between the pressure pump and the second air-bubble atomizer as described in the second aspect of the invention. Consequently, the liquid feeding pressure can be stabilized, thereby to reduce variation in production of air bubbles by the second air-bubble atomizer.

According to a fourth aspect of the invention, there is provided an apparatus for producing microbubble liquid, wherein the second air-bubble atomizer as described in any of the first through third aspects of the invention comprises an upstream-side bubble liquid passage having a certain cross section over a prescribed range along the liquid feeding pipeline, and a downstream-side bubble liquid passage provided on the downstream side and having a cross section gradually widening from the upstream side toward the downstream side relative to the liquid feeding direction, whereby atomization of the air bubbles can be performed with high efficiency.

According to a fifth aspect of the invention, there is provided an apparatus for producing microbubble liquid, wherein the second air-bubble atomizer as described in any of the first through third aspects of the invention comprises an upstream-side bubble liquid passage having a certain cross section over a prescribed range along the liquid feeding pipeline, a downstream-side bubble liquid passage provided on the downstream side and having a cross section gradually widening from the upstream side toward the downstream side relative to the liquid feeding direction, and a liquid volume adjusting mechanism for controlling the air bubble liquid in volume fed into the upstream-side bubble liquid passage, thereby to enable production of the desired amount of air bubble liquid.

According to a sixth aspect of the invention, there is provided an apparatus for producing microbubble liquid, wherein the second air-bubble atomizer as described in any of the first through third aspects of the invention comprises an upstream-side bubble liquid passage having a certain cross section over a prescribed range along the liquid feeding pipeline, which upstream-side bubble liquid passage is formed inside an outer cylinder having a partition wall in which a liquid inflow port is bored on the upstream side relative to the liquid feeding direction and an outlet port opening on the downstream-side relative to the liquid feeding direction, and a downstream-side bubble liquid passage provided continuously on the downstream side of the upstream-side bubble liquid passage and having a cross section gradually widening from the upstream side toward the downstream side relative to the liquid feeding direction, thereby to increase the pressure by the partition wall of the outer cylinder and efficiently disintegrate the air bubbles in the bubble liquid passing through the liquid passages due to pressure change in the liquid passages gradually widening from the upstream side toward the downstream side relative to the liquid feeding direction, consequently to atomize the air bubbles into finer size bubbles.

According to a seventh aspect of the invention, there is provided an apparatus for producing microbubble liquid, wherein the second air-bubble atomizer as described in any of the first through third aspects of the invention comprises an upstream-side bubble liquid passage having a certain cross section over a prescribed range along the liquid feeding pipeline, a downstream-side bubble liquid passage provided continuously on the downstream side of the upstream-side bubble liquid passage and having a cross section gradually widening from the upstream side toward the downstream side relative to the liquid feeding direction, and a liquid volume adjusting mechanism for controlling the air bubble liquid in volume fed into the upstream-side bubble liquid passage, thereby to increase the pressure by the partition wall of the outer cylinder and efficiently disintegrate the air bubbles in the bubble liquid passing through the liquid passages due to pressure change in the liquid passages gradually widening from the upstream side toward the downstream side relative to the liquid feeding direction, consequently to atomize the air bubbles into finer size bubbles and enable production of the desired amount of air bubble liquid.

According to an eighth aspect of the invention, there is provided an apparatus for producing microbubble liquid, wherein the second air-bubble atomizer as described in any of the first through third aspects of the invention comprises a shaft member having a large diameter part with a certain outer diameter over a prescribed range along the liquid feeding direction so as to form an upstream-side bubble liquid passage in a partition form having a certain cross section over a prescribed range along the liquid feeding pipeline, and a contractive diameter part having a diameter tapering toward the downstream side relative to the liquid feeding direction so as to form a downstream-side bubble liquid passage provided on the downstream side and having a cross section gradually widening from the upstream side toward the downstream side relative to the liquid feeding direction, which shaft member is arranged coaxially with the outer cylinder having a constant inner diameter, thereby to enable simplification of the structure of the apparatus. Since there is no need to use expensive porous ceramics for the apparatus of the invention, the apparatus can be manufactured at a low cost.

According to a ninth aspect of the invention, there is provided an apparatus for producing microbubble liquid, wherein the second air-bubble atomizer as described in any of the first through third aspects of the invention comprises a shaft member having a large diameter part with a certain outer diameter over a prescribed range along the liquid feeding direction so as to form an upstream-side bubble liquid passage in a partition form having a certain cross section over a prescribed range along the liquid feeding pipeline, and a contractive diameter part having a diameter tapering toward the downstream side relative to the liquid feeding direction so as to form a downstream-side bubble liquid passage provided on the downstream side and having a cross section gradually widening from the upstream side toward the downstream side relative to the liquid feeding direction, which shaft member is arranged coaxially with the outer cylinder having a constant inner diameter, and a liquid volume adjusting mechanism for controlling the air bubble liquid in volume fed into the upstream-side bubble liquid passage, thereby to enable simplification of the structure of the apparatus and production of the desired amount of air bubble liquid.

According to a tenth aspect of the invention, there is provided an apparatus for producing microbubble liquid, wherein the first air-bubble atomizer as described in any of the first through third aspects of the invention includes a bubble liquid passage provided on the downstream side and having a cross section gradually widening from the upstream side toward the downstream side relative to the liquid feeding direction, thereby to enable effective production of the air bubble liquid containing air bubbles having suitable sizes for atomizing of the air bubbles in the second air-bubble atomizer.

According to an eleventh aspect of the invention, there is provided an apparatus for producing microbubble liquid, wherein the first air-bubble atomizer as described in any of the first through third aspects of the invention includes a bubble liquid passage having a cross section gradually widening from the upstream side toward the downstream side relative to the liquid feeding direction, which bubble liquid passage is formed inside an outer cylinder having a partition wall in which a liquid inflow port is bored on the upstream side relative to the liquid feeding direction and an outlet port opening on the downstream-side relative to the liquid feeding direction, thereby to enable effective production of the air bubble liquid containing air bubbles having suitable sizes for atomizing of the air bubbles in the second air-bubble atomizer.

According to a twelfth aspect of the invention, there is provided an apparatus for producing microbubble liquid, wherein the first air-bubble atomizer as described in any of the first through third aspects of the invention comprises a shaft member having a diameter tapering from the upstream side toward the downstream side relative to the liquid feeding direction so as to form a bubble liquid passage in a partition form having a cross section gradually widening from the upstream side toward the downstream side relative to the liquid feeding direction, which shaft member is arranged coaxially with the outer cylinder having a constant inner diameter, thereby to enable simplification of the structure and effective production of the air bubble liquid containing air bubbles having suitable sizes for atomizing of the air bubbles in the second air-bubble atomizer.

According to a thirteenth aspect of the invention, there is provided an apparatus for producing microbubble liquid, wherein liquid to be treated is stored in a reservoir for feeding the air bubble liquid from the second air-bubble atomizer as described in any of the first through third aspects of the invention, and the second air-bubble atomizer is arranged at a place that is impervious to the liquid to be treated, which is stored in the reservoir, thereby to prevent adhesion of microbes ascribable to immersion into the liquid to be treated.

According to a fourteenth aspect of the invention, there is provided an apparatus for producing microbubble liquid, wherein liquid to be treated is stored in a reservoir for feeding the air bubble liquid from the second air-bubble atomizer as described in any of the first through third aspects of the invention, and the second air-bubble atomizer is arranged so as to be immersed in the liquid to be treated, which is stored in the reservoir, thereby to enable direct supply of the air bubble liquid into the liquid to be treated.

According to a fifteenth aspect of the invention, there is provided an apparatus for producing microbubble liquid, which comprises an upstream-side bubble liquid passage having a certain cross section over a prescribed range along the liquid feeding pipeline, and a downstream-side bubble liquid passage having a cross section gradually widening from the upstream side toward the downstream side relative to the liquid feeding direction, whereby atomization of the air bubbles can be performed with high efficiency.

According to a sixteenth aspect of the invention, there is provided an apparatus for producing microbubble liquid, which comprises a liquid volume adjusting mechanism for controlling the air bubble liquid in volume fed into the upstream-side bubble liquid passage, thereby to enable production of the desired amount of air bubble liquid.

BRIEF DESCRIPTION OF THE DRAWINGS

FIG. 2 Front view of the state of connecting an air bubble liquid producing means to a first air-bubble atomizer.

FIG. 3 Front view of the first air-bubble atomizer.

FIG. 5 FIG. 5(A) is one side view of the first air-bubble atomizer.

EXPLANATION OF REFERENCE LETTERS OR NUMERALS

10 Feed-water tank (liquid supply source)
20*a* Side wall (partition wall)
70 Outer cylinder (second air-bubble atomizer)
70*c* Liquid inflow port
70*a* Side wall (partition wall)
71 and 80 shaft member
71*c* and 80*c* Large diameter part
71*d* and 80*d* Contractive diameter part
A air bubble liquid producing means
B First air-bubble atomizer
D Pressure pump
E Pressure stabilizing tank
F Second air-bubble atomizer (device for atomizing air bubbles)
G Liquid volume adjusting mechanism
P Liquid feeding pipeline
β Upstream-side bubble liquid passage
γ Downstream-side bubble liquid passage

DETAILED DESCRIPTION OF THE INVENTION

Figure 1:
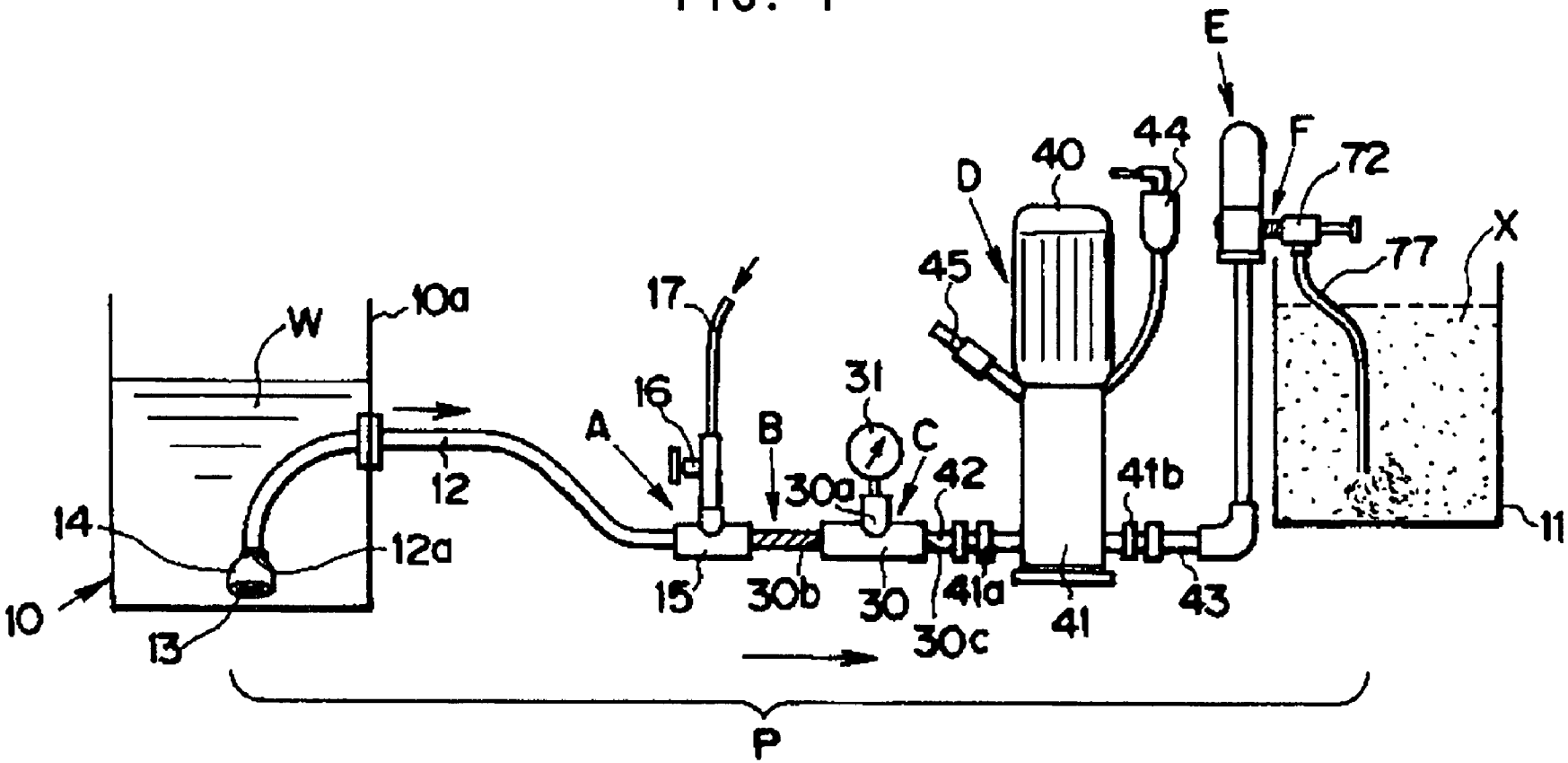
FIG. 1 Configuration diagram of an apparatus for producing microbubble liquid in one embodiment according to the invention.

Next, one embodiment of the invention will be described with reference to the accompanying drawings. FIG. 1 is a configuration diagram of an apparatus for producing microbubble liquid in one embodiment according to the invention. The apparatus for producing the microbubble liquid in the embodiment according to the invention has a function of producing the microbubble liquid containing fully microscopic air bubbles and comprises an air bubble liquid producing means A, a first air-bubble atomizer B, a pressure instrumentation C, a pressure pump D, a pressure stabilizing tank E and a second air-bubble atomizer F, which are arranged in sequence from the upstream side toward the downstream side relative to the liquid feeding direction of a liquid feeding pipeline P extending from a feed-water tank 10 storing water W to a reservoir 11 storing liquid to be treated such as waste liquid.

Incidentally, the embodiment described herein employs "water W" as fluid and "air" as gas by way of example, but may use other fluid or solution and other gas as alternated. The "water W" may be of purified water or natural water such as that of a river, pond or lake.

The feed-water tank 10 is formed in a cubic shape having an upper opening to store the water W. The feed-water tank 10 is on one side wall 10*a* with a water intake pipe 12 forming a part of the liquid feeding pipeline P.

To a water intake port 12*a* of the water intake pipe 12, there is attached a water intake means 14 with a mesh filter 13 for removing foreign particles contaminated in the water W in the feed-water tank 10.

In this embodiment, by way of example, and not limitation, the feed-water tank 10 serves as a liquid supply source, and instead, a river, pond or lake may serve as the liquid supply source.

Figure 4:
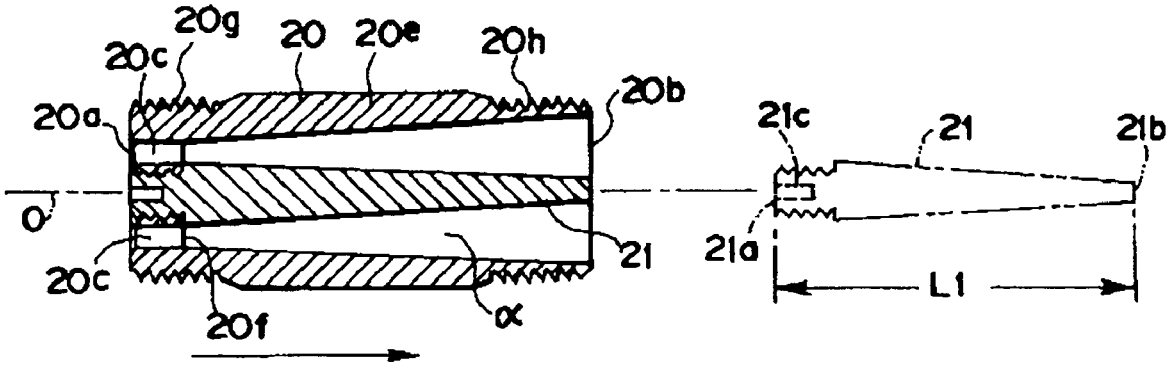
FIG. 4 Front sectional view of the first air-bubble atomizer.
Figure 5A:
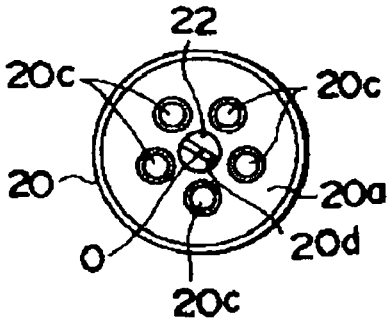
Figure 5B:
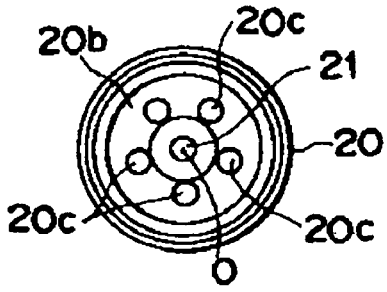
FIG. 5(B) is the other side view of the first air-bubble atomizer.

FIG. 2 is a front view of the state of connecting an air bubble liquid producing means to a first air-bubble atomizer, FIG. 3 is a front view of the first air-bubble atomizer, FIG. 4 is a front sectional view of the first air-bubble atomizer, FIG. 5(A) is one side view of the first air-bubble atomizer, and FIG. 5(B) is the other side view of the first air-bubble atomizer.

The air bubble liquid producing means A has a function of producing the air bubble liquid having the water W mixed with air by an aspirating pressure of a pressure pump as described later. The air bubble liquid producing means is formed by threadably connecting a variable valve 16 for controlling the amount of air being sucked thereinto to an upper connecting port 15*a* of a so-called T-type three-way pipe joint 15 as shown in FIG. 2.

One end of an air intake tube 17 for introducing ambient atmosphere (air) is connected to the variable valve 16 and the other end of the air intake tube 17 is open to the atmosphere. To an intake-side connecting port 15*b*, there is connected the other end of the water intake pipe 12. An outlet-side connecting port 15*c* is threadably connected to a first air-bubble atomizer B as described hereinafter.

The first air-bubble atomizer B is formed of for instance, metal such as stainless steel. The first air-bubble atomizer is formed by disposing a shaft member 21 coaxially within an outer cylinder 20 of a substantially tubular type as shown in FIG. 2 through FIG. 5. That is, the shaft member 21 and the outer cylinder 20 are arranged coaxially around the center axis O.

The outer cylinder 20 has a side wall (partition wall) 20*a* on the upstream side relative to the liquid feeding direction and an outlet port 20*b* in the downstream side relative to the liquid feeding direction.

In the side wall 20*a*, there are arranged five liquid inflow ports 20*c* in a circle at an angular interval of 36 degrees around the center axis O as shown in FIG. 5, and similarly, insertion holes 20*d* through which screws 22 are inserted for securing the shaft member 21 are formed around the center axis O. The disposition of the liquid inflow ports 20*c* is not specifically limited to the circle. That is, the liquid inflow ports may be arranged elliptically or polygonally, and the size each of the ports may be designed ad libitum.

The outer peripheral wall 20*e* of the outer cylinder 20 has a tapered inner surface having an inner diameter gradually increasing from the inner surface 20*f* of the side wall 20*a* to the outlet port 20*b*. That is, a truncated cone-shaped space is formed inside the outer cylinder 20. The outer peripheral wall 20*e* is provided at its both ends with screw threads 20*g* and 20*h* and at its center part with flat portions 20*i* to be caught by a tool (not shown) for rotating the outer cylinder 20.

The shaft member 21 is formed in a substantially truncated cone shape having a diameter tapering from a basal end surface 21*a* coming in contact with the side wall 20*a* to a distal surface 21*b* as shown in FIGS. 4 and 5. In the center of the basal end surface 21*a*, there is formed a screw hole 21*c* for fitting a screw 22 thereinto. That is, the shaft member 21 has a diameter tapering from the upstream side toward the downstream side relative to the liquid feeding direction so as to form a bubble liquid passage in a partition form having a cross section gradually widening from the upstream side toward the downstream side relative to the liquid feeding direction.

The outer diameter of the basal end surface 21*a* of the shaft member 21 is formed so as not to close the liquid inflow port 20*c*. The length L1 of the shaft member 21 is designed so as to have the distal surface 21*b* lined up substantially with the outlet port 20*b* of the outer cylinder 20 as seen from the front when the basal end surface 21*a* is in collision with the inner surface 20*f* of the side wall 20*a*.

That is, by threadably mounting the shaft member 21 onto the side wall 20*a* of the outer cylinder 20, the shaft member 21 is secured on the outer cylinder 20 in agreement with the center axis O. In other words, the shaft member 21 is disposed coaxially with the outer cylinder 20. Thus, a bubble liquid passage α is formed between the inner surface of the outer peripheral wall 20*e* and the outer peripheral surface of the shaft member 21 in a partition form having a cross section gradually widening from the upstream side toward the downstream side relative to the liquid feeding direction.

That is, the bubble liquid passage gradually widening from the upstream side toward the downstream side relative to the liquid feeding direction α is formed within the outer cylinder 20.

The pressure of the air bubble liquid produced by the air bubble liquid producing means A is increased by the side wall 20*a* of the outer cylinder 20, while air bubbles in the air bubble liquid are disintegrated by a calibration action in the liquid inflow ports 20*c* and air bubble liquid passage α.

The "calibration action" is a phenomenon in which the air bubbles is disintegrated and atomized into finer size bubbles due to abrupt change of pressure caused in the direction from the upstream side toward the downstream side relative to the liquid feeding direction.

Although the outer cylinder 20 and the shaft member 21 are separate from each other in this embodiment, they may of course be united in one body.

A pressure instrumentation C comprises a pressure gauge 31 connected to a upper connecting port 30*a* of a pipe joint 30 similar to the aforementioned pipe joint 15 as shown in FIG. 1. To the inlet-side connecting port 30*b* of the pipe joint 30, there is connected the aforementioned first air-bubble atomizer B, and to the outlet-side connecting port 30*c*, there is connected a pump unit 41 of the pressure pump D that will be described later.

Although the aspirating pressure of the pressure pump D can be regulated on the basis of a pressure measured by the pressure instrumentation C in this embodiment, the pressure instrumentation C may be used according to need.

As shown in FIG. 1, the pressure pump D comprises a motor 40 and a pump unit 41 driven by the motor 40 so as to aspirate the water W in the feed-water tank 10 by the prescribed inspiratory and exhaust forces of the pump and then forcibly forward the water W to the liquid feeding pipeline.

The pressure instrumentation C is connected to a water inlet port 41*a* of the pump unit 41 through a connecting pipe 42. To a water outlet port 41*b*, there is connected a connecting pipe 43.

Denoted by 44 is a valve for discharging air from the pump unit 41. Denoted by 45 is an inlet port for introducing water required for starting up the apparatus of this invention.

Figure 6:
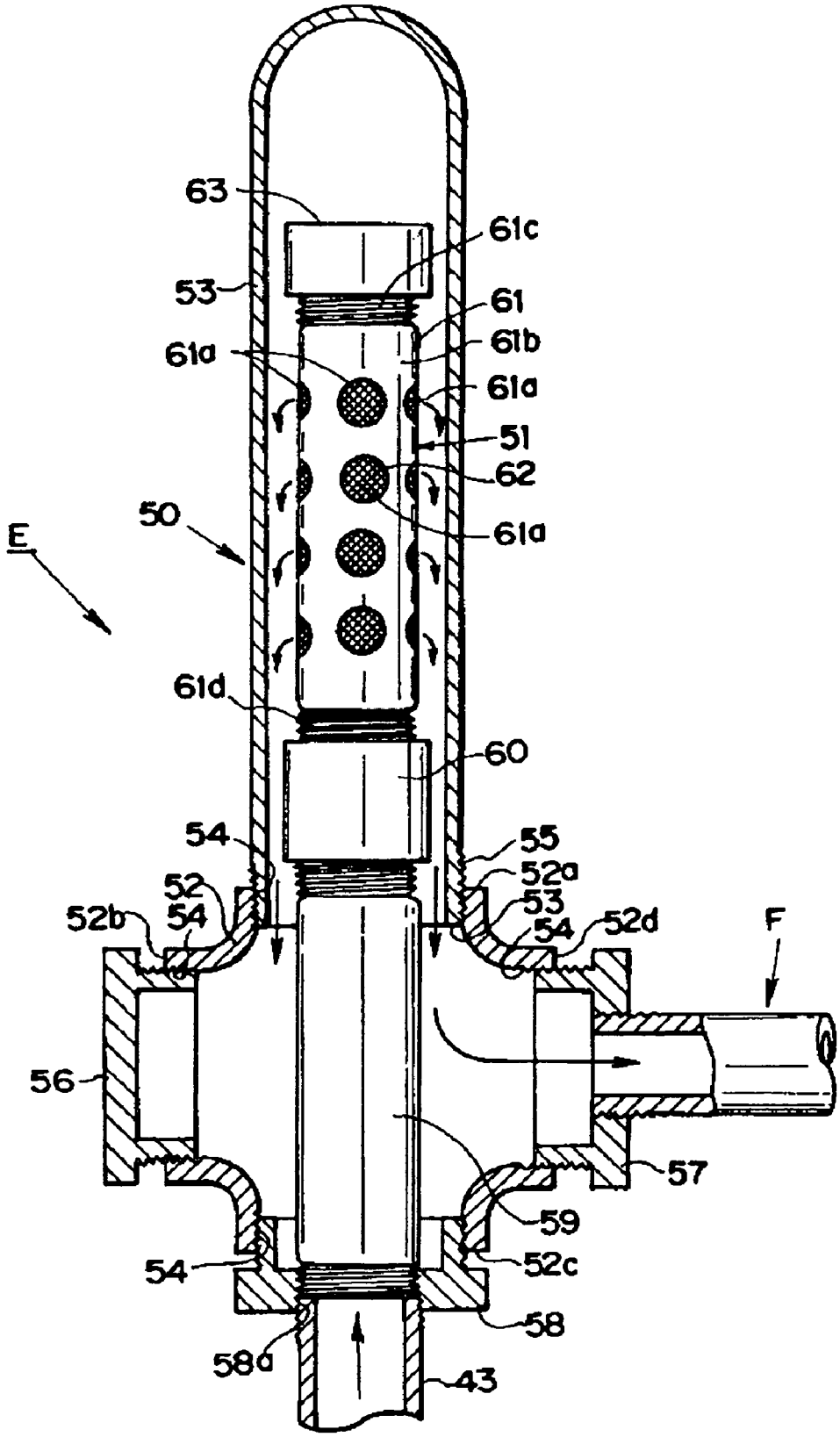
FIG. 6 Detailed front sectional view showing a pressure stabilizing tank.

FIG. 6 is a detailed front sectional view showing a pressure stabilizing tank. As shown in FIG. 1, the connecting pipe 43 has its lower end portion (one end portion) connected to the pump unit 41 of the aforementioned pressure pump D and formed arising from the lower end portion in a left-right reversed L-shape. On the top end (other end portion) of the connecting pipe 43, a pressure stabilizing tank E is secured.

As shown in FIG. 6, the pressure stabilizing tank E includes a water blowout portion 51 and has a function of stabilizing the pressure of the water fed through the connecting pipe 43 and the pressure of the air bubble liquid being fed to a second air-bubble atomizer F as described later.

The tank portion 50 comprises a distributor 52 for distributing the water fed through the connecting pipe 43, and a cylindrical receptacle 53 connected watertightly to the distributor 52. The distributor 52 is formed in a follow configuration having connecting ports 52*a*, 52*b*, 52*c* and 52*d* opening in four directions of the horizontal (weft) directions and vertical (warp) directions. The connecting ports 52*a*, 52*b*, 52*c* and 52*d* each have an inner wall with a threaded part 54.

The receptacle 53 is formed in a cylinder having a lower surface with an opening 53*a* and an upper surface closed. On the outer wall surface of the lower part of the receptacle, there is formed a threaded part 55.

That is, by threadably connecting the threaded part 54 of the connecting port 52*a* of the distributor 52 to the threaded part 55 of the receptacle 53, watertight connection thereof can be fulfilled.

Further, to the connecting port 52*b* formed in one side of the distributor 52, there is threadably connected a water shutoff valve 56. To the connecting port 52*d* on the other side of the distributor, the second air-bubble atomizer F described later is connected through a connection plug 57.

By removing the water shutoff valve 56 from the connecting ports 52*b* and threadably mounting the connection plug 57 onto the connecting ports 52*b*, another second air-bubble atomizer can be connected thereto. That is, two second air-bubble atomizers can be used simultaneously.

To the connecting ports 52*c* on the lower side of the distributor 52, there is threadably connected watertightly a connection plug 58 having a threaded hole 58*a* in its center part. Into the threaded hole 58*a*, the aforementioned connecting pipe 43 and the water blowout portion 51 described later are threadably mounted.

The water blowout portion 51 comprises an inner connecting pipe 59 screwed in the threaded hole 58*a* of the connection plug 58 and a blowout member 61 connected to the upper part of the inner connecting pipe through a connector 60.

The blowout member 61 is formed in such a manner that a cylindrical mesh filter 62 for removing foreign particles contaminated in the water W being forcibly fed is contained within a main body 61*b* having upper and lower openings and water blowout ports 61*a* formed in a circle at certain intervals in the peripheral wall.

The main body 61*b* is provided on its upper and lower end peripheries with threaded parts 61*c* and 61*d*. A cleaning cap 63 is threadably and detachably fitted onto the threaded part 61*c* of the upper end periphery of the main body. By detaching the cleaning cap 63, cleaning inside the main body 61*b* and replacement of the mesh filter 62 can easily be carried out. The threaded part 61*d* is adapted to threadably retain the connector 60.

Figure 7:
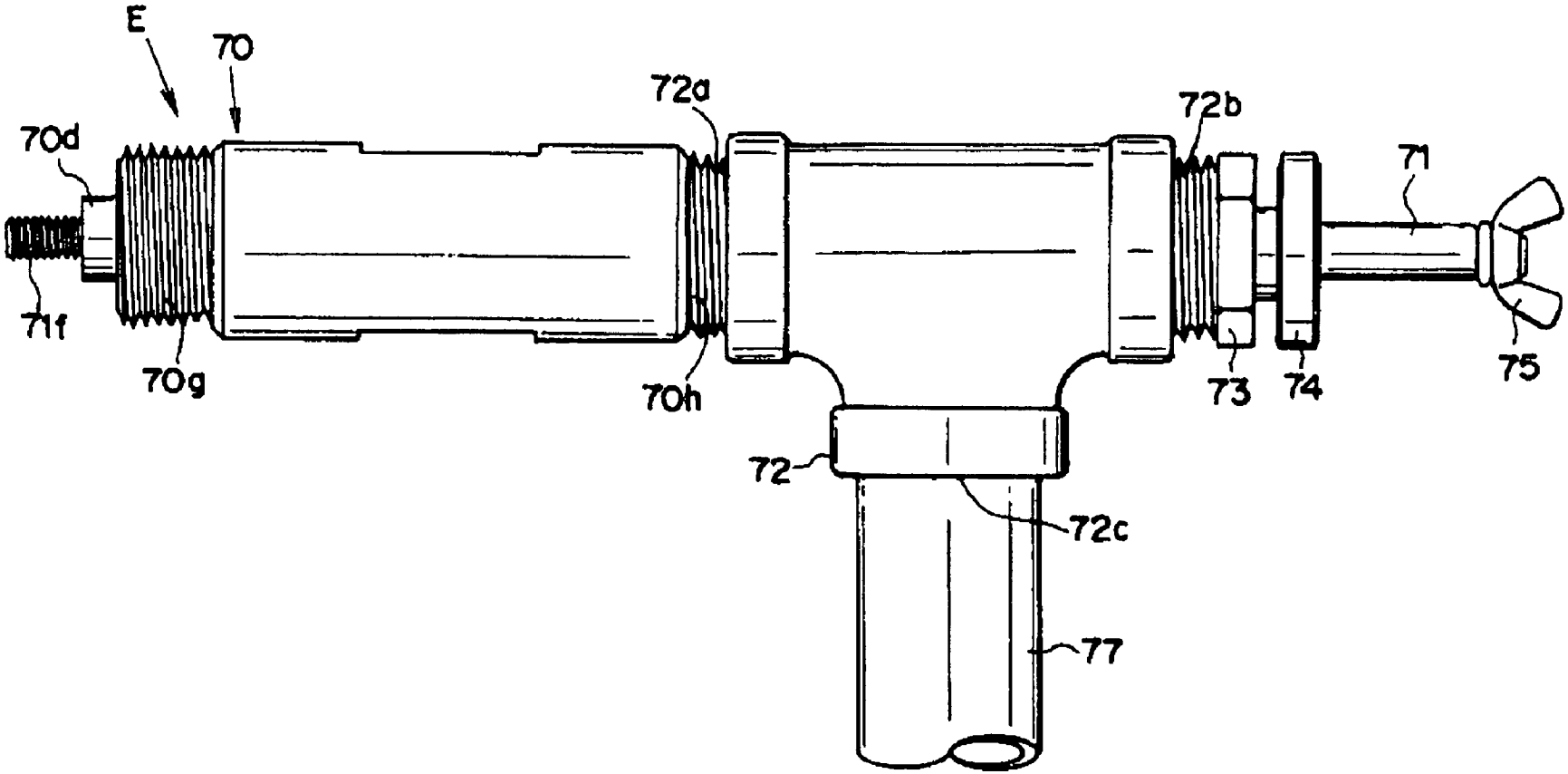
FIG. 7 Front view of the state of connecting a second air-bubble atomizer to a pipe joint in the embodiment of the invention.
Figure 8:
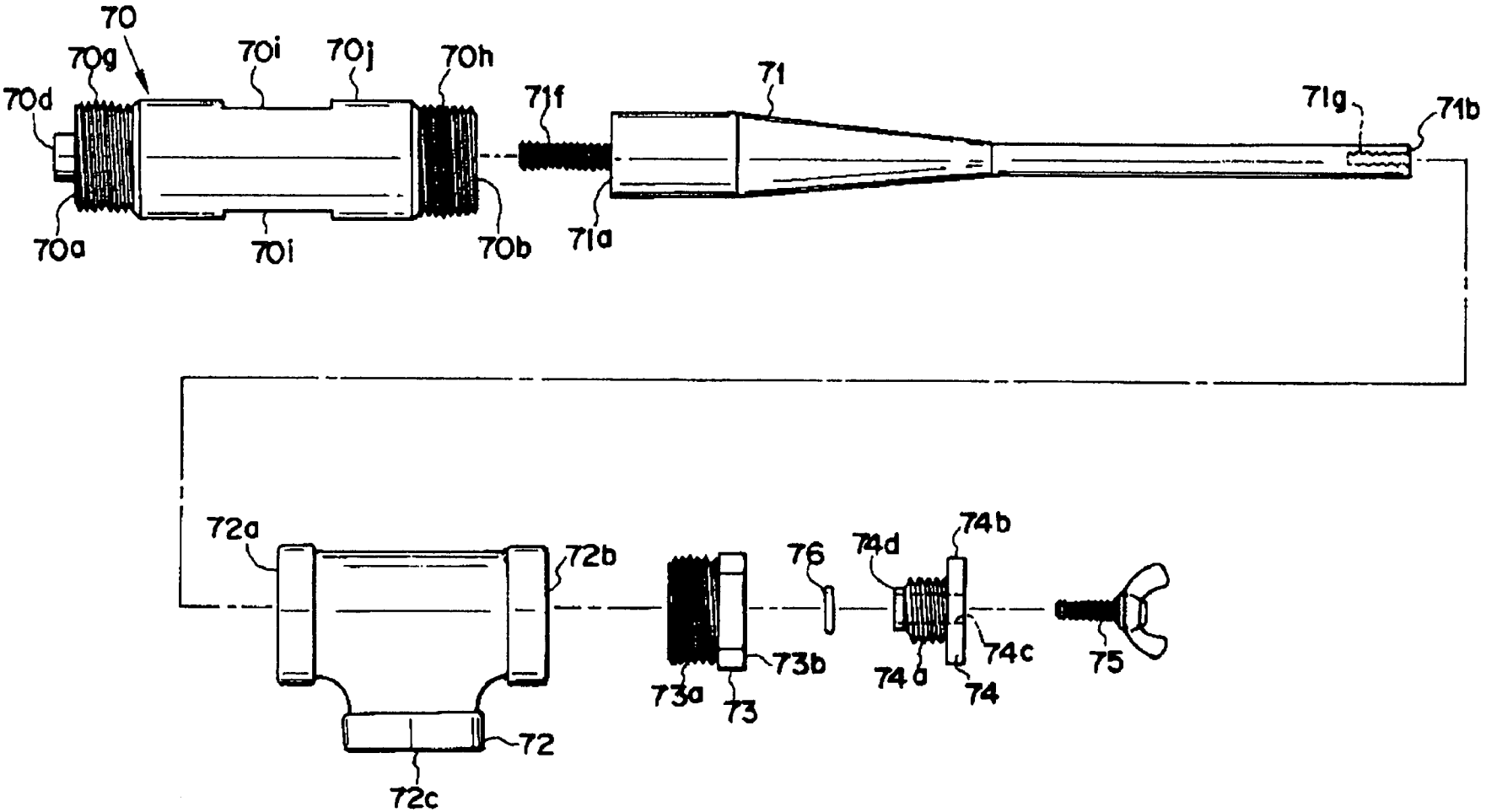
FIG. 8 Exploded view of the second air-bubble atomizer in the embodiment of the invention.
Figure 9:
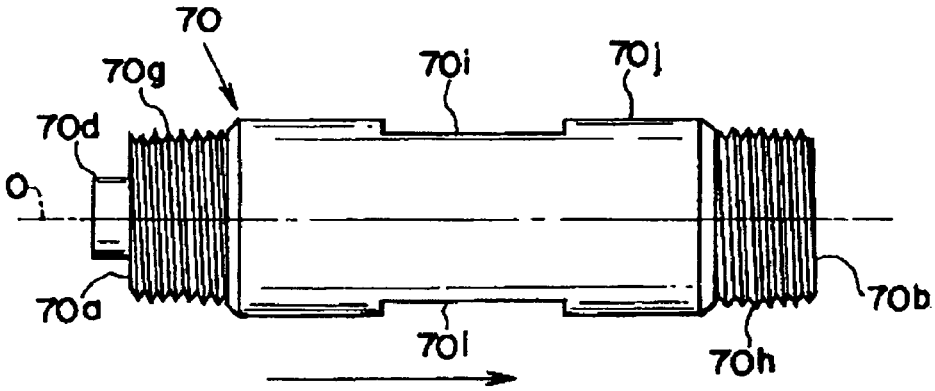
FIG. 9 Front view of the second air-bubble atomizer in the embodiment of the invention.
Figure 10:
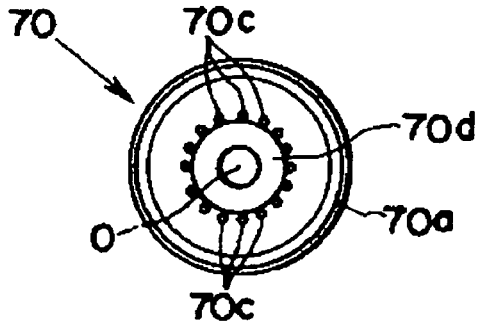
FIG. 10 One side view of the second air-bubble atomizer in the embodiment of the invention.
Figure 11:
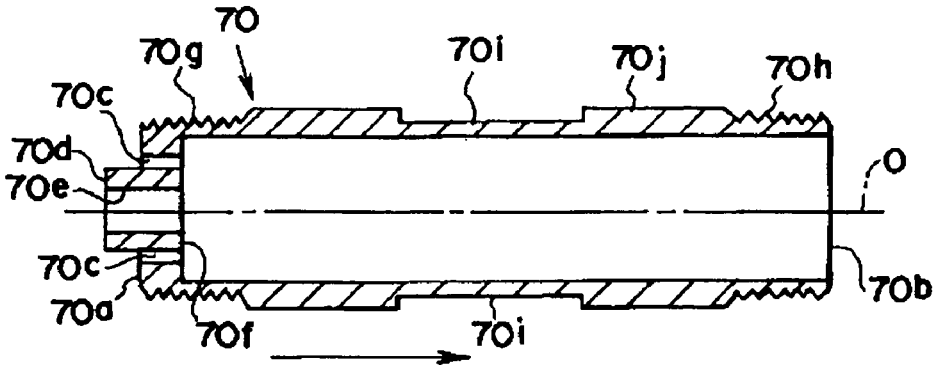
FIG. 11 Other side view of the second air-bubble atomizer in the embodiment of the invention.
Figure 12:
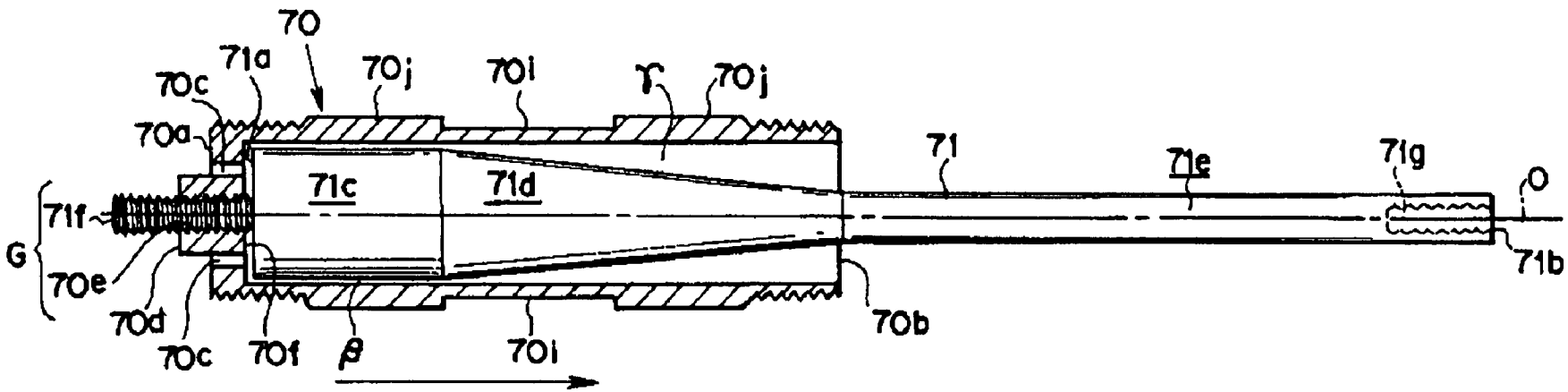
FIG. 12 Sectional view of the state of inserting a shaft member into an outer cylinder.
Figure 13:
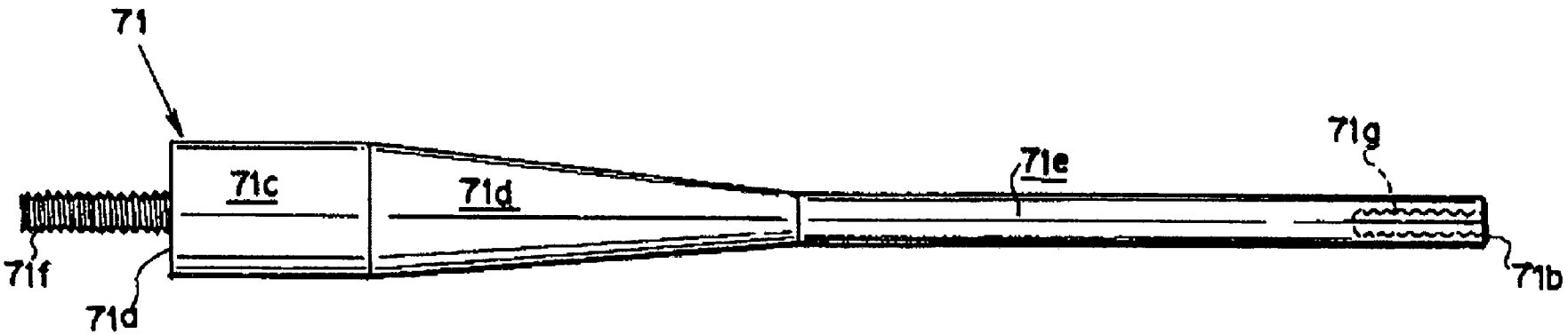
FIG. 13 Front view of the shaft member.

Next, the second air-bubble atomizer in the first embodiment of the invention will be described with reference to FIG. 7 through FIG. 14. FIG. 7 is a front view of the state of connecting a second air-bubble atomizer to a pipe joint in the embodiment of the invention, FIG. 8 is an exploded view of the second air-bubble atomizer in the embodiment of the invention, FIG. 9 is a front view of the second air-bubble atomizer in the embodiment of the invention, FIG. 10 and FIG. 11 are one side view and other side view of the second air-bubble atomizer, FIG. 12 is a sectional view of the state of inserting a shaft member into an outer cylinder, and FIG. 13 is a front view of the shaft member.

As shown in FIG. 1, the second air-bubble atomizer F is placed on the lateral side of the aforementioned pressure tank E above the reservoir 11. That is, the second air-bubble atomizer F is arranged so as not to be immersed in treating liquid X stored in the reservoir 11. Thus, since the second air-bubble atomizer F is not immersed in the treating liquid in the reservoir 11, adhesion of microbes ascribable to immersion into the liquid to be treated can be prevented.

The second air-bubble atomizer F is formed of, for instance, metal such as stainless steel. The first air-bubble atomizer is formed by disposing a shaft member 71 coaxially within an outer cylinder 70 of a substantially tubular type as shown in FIG. 12, thereby to form an upstream-side bubble liquid passage β having a certain cross section over a prescribed range along the liquid feeding pipeline P, and a downstream-side bubble liquid passage γ provided on the downstream side and having a cross section gradually widening from the upstream side toward the downstream side relative to the liquid feeding direction. Denoted by 72 is pipe joint. Denoted by 73 and 74 are support members.

As shown in FIGS. 9-12, the outer cylinder 70 has a side wall 70*a* serving as a partition wall on the side surface on the upstream side relative to the liquid feeding direction and an outlet port 70*b* opening in the side surface on the downstream side relative to the liquid feeding direction.

In the side wall 70*a*, there are arranged sixteen liquid inflow ports 70*c* in a circle at an angular interval of 22.5 degrees around the center axis O.

At the center axis O of the side wall 70*a*, a boss 70*d* is projected on the outer wall surface side and a threaded hole 70*e* to be threadably connected to the shaft member 71 is formed.

Incidentally, the number of the liquid inflow ports 70*c* is not specifically limited to sixteen as described above and may be arbitrarily determined taking the volume of the air bubbles in the air bubble liquid into consideration. Likewise, the shape of the liquid inflow port is not specifically limited to a round shape and may be formed in an ellipse or a polygonal shape. Further, the size of the liquid inflow port may also be arbitrarily determined.

The inner surface of the threaded hole 70*e* of the outer cylinder 70 is formed to have a constant inner diameter from the inner surface 70*f* of the side wall 70*a* to the outlet port 70*b*. That is, within the outer cylinder 70, there is defined a space formed in a cylindrical shape.

The outer peripheral wall 70*e* is provided at its both ends with screw threads 70*g* and 70*h* and at its center part with flat portions 70*i* to be caught by a tool (not shown) for rotating the outer cylinder 70.

As shown in FIGS. 8, 12 and 13, the shaft member 71 has a large diameter part 71*c* with a certain outer diameter over a prescribed range from the basal end surface 71*a* to the distal surface 71*b* opposite to the side wall 70*a* of the outer cylinder 70, a contractive diameter part 71*d* having a diameter tapering over a prescribed range from the large diameter part 71*c* to the distal surface 71*b*, and a small diameter part 71*d* having a diameter smaller than the aforementioned large diameter part 71*c* to the distal surface 71*b*. The shaft member is made longer than a total length of the outer cylinder 70 and the T-shaped pipe joint 72.

The relative relationship between the large diameter part 71*c* and the contractive diameter part 71*d* is determined such that the length of the contractive diameter part 71*d* is approximately two times that of the large diameter part 71*c* by way of example.

The basal end surface 71*a*, i.e. the large diameter part 71*c*, has an outer diameter determined taking the opposite liquid inflow ports 70*c* into consideration. A threaded part 71*f* to be threadably fitted in the aforementioned threaded hole 70*e* protrudes outward along the center axis. In the distal surface 71*b*, there is formed a threaded hole 71*g* to threadably receive a thumbscrew 75.

The threading connection of the shaft member 71 to the outer cylinder 70 allows the shaft member 71 to be consistent with the center axis O of the outer cylinder 70, thus to form an upstream-side and downstream-side bubble liquid passages β and γ in partition forms between the inner surface of the outer peripheral wall 70*f* and the outer peripheral wall of the shaft member 71 as shown in FIG. 12.

The basal end surface 71*a* of the shaft member 71 has a conically curved surface having the basal portion of the threaded part 71*f* as an apex. Even when the basal end surface 71*a* comes in contact with the inner surface 70*f* of the side wall 70*a*, an interspace extending from the liquid inflow ports 70*c* to the upstream-side bubble liquid passage β can be ensured.

The basal end surface is formed in a conically curved shape in this embodiment, but not limited thereto, and instead, it may have a flat shaped basal end surface and a conically curved inner surface of the side wall. Alternatively, both the surfaces may be conically curved. The basal end surface is not necessarily formed in the aforementioned conically curved shape, and may be formed by protruding the boss toward a portion that is not opposite to the liquid inflow ports.

That is, it is only necessary to provide one or both of the basal end surface and the side wall with at least one pair of concave and convex for ensuring the interspace extending from the liquid inflow ports 70*c* to the upstream-side bubble liquid passage β.

According to the aforementioned structure, by threadably fitting the threaded part 71*f* of the shaft member 71 into the threaded hole 70*e* in the side wall 70*a* of the outer cylinder 70 and rotating the shaft member 71 forwardly or reversely by means of the thumbscrew 75, the interspace formed between the basal end surface 71*a* of the shaft member 71 and the inner surface 70*f* of the side wall 70*a* can be adjusted arbitrarily.

Thus, by adjusting the interspace, the fluid volume of the air bubble liquid flowing into the upstream-side bubble liquid passage β can be controlled to increase or decrease the flow rate of the air bubble liquid. Besides, the conically curved surface of the basal end surface 71*a* of the shaft member 71 can ensure the interspace between the basal end surface 71*a* and the inner surface 70*f* of the side wall 70*a* even when bringing the basal end surface 71*a* of the shaft member 71 into contact with the side wall 70*a*, thus to prevent unconsidered discontinuation of flowing the air bubble liquid.

A liquid volume adjusting mechanism G for controlling the fluid volume of the air bubble liquid flowing into the upstream-side and downstream-side bubble liquid passages β and γ is formed by the threaded part 71*f* of the shaft member 71 and the threaded hole 70*e* of the outer cylinder 70 as shown in FIG. 12 in this embodiment.

In this embodiment, by protruding a tip end of the shaft member 71 outside a connecting port 72*b* of the pipe joint 72 connected to the outer cylinder 70, it becomes possible to easily adjust the liquid volume of the air bubble liquid without detaching the pipe joint 72 by way of example.

Incidentally, the structure such that "the large diameter part 71*c* has an outer diameter determined taking the opposite liquid inflow ports 70*c* into consideration" as touched upon above implies that the liquid inflow ports 70*c* are wrapped over the basal end surface 71*a* as viewed from the side (in the liquid feeding direction).

The pipe joint 72 is a so-called T-type pipe joint having connecting ports 72*a*, 72*b* and 72*c* opening in three directions. The connecting ports 72*a*, 72*b* and 72*c* each have an inner peripheral surface with a threaded part (not shown). The connecting port 72*c* of the pipe joint 72 in this embodiment is connected to a flow-down pipe 77 to discharge the air bubble liquid.

Figure 14A:
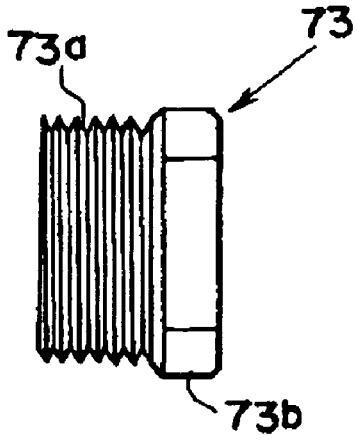
FIG. 14 Front view of the state of connecting the second air-bubble atomizer to the pipe joint in the other embodiment of the invention.
Figure 14B:
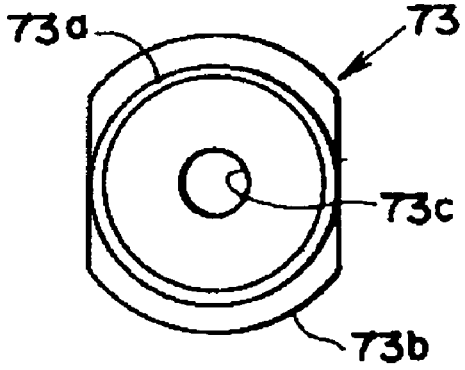
Figure 14C:
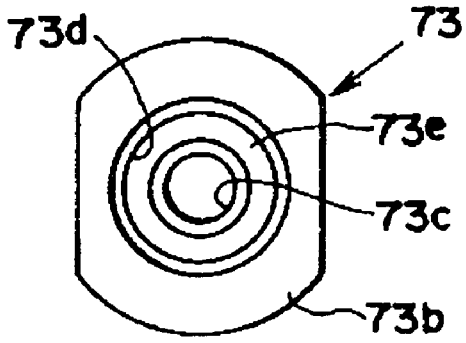

A support member 73 is formed in a substantially cylindrical shape comprising a threaded part 73*a* threadably fitted to the thread part of the connecting port 72*b* of the pipe joint 72 and a flange 73*b* having a larger diameter than that of the threaded part 73*a* as shown in FIG. 14.

In the center part of the support member, there is formed a loose-insertion hole 73*c* into which the small diameter part 71*e* of the aforementioned shaft member 71 can be inserted loosely. In the other side portion thereof, there is formed a threaded hole 73*d* for threadably fitted to a support member 74.

Denoted by 73*e* is a pair of flat portions formed in the flange 73*b* to be caught by a tool (not shown).

As shown in FIG. 8, the support member 74 is formed in a substantially cylindrical shape comprising a threaded part 74*a* formed on the one side portion thereof so as to be threadably fitted to the threaded hole 73*d* of the support member 73 and a disk-like flange 74*b* formed on the other side portion thereof. At the center axis O thereof, there is formed a loose-insertion hole 74*c* into which the small diameter part 71*e* of the aforementioned shaft member 71 can be inserted loosely.

On the distal surface of the threaded part 74*a*, there is formed a convex fringe ring 74*d* for bringing an O-ring 76 into tight contact with a bottom 73*e* of the threaded hole 73*d* of the support member 73. The O-ring 76 has a function of preventing leakage of water through a fine gap possibly formed the shaft member 71 and the loose-insertion hole 73*c* of the support member 73.

Next, the operational function of the aforementioned apparatus according to the invention will be described.

When the water fed from the feed-water tank 10 is forcibly fed into the liquid feeding pipeline P, ambient atmosphere (air) is introduced from the air intake tube 17 by the action of the aspirating pressure of the water and mixed with the water within the pipe joint 15 of the air bubble liquid producing means A, consequently to produce air bubble liquid.

While forcibly feeding the air bubble liquid to the first air-bubble atomizer B, the pressure of the liquid is increased by means of the side wall 20*a* of the outer cylinder 20. At that time, the air bubbles in the air bubble liquid passing through the bubble liquid passage α are atomized into even smaller bubbles due to pressure change in the liquid passages gradually widening from the upstream side toward the downstream side relative to the liquid feeding direction.

The air bubble liquid containing air microbubbles thus obtained in the first air-bubble atomizer B is stabilized in its flow volume and forcibly fed to the second air-bubble atomizer F, thus to increase its pressure by means of the side wall 70*a* of the outer cylinder 70.

Then, the air bubbles in the air bubble liquid passing through the upstream-side and downstream-side bubble liquid passages β and γ are disintegrated and atomized into finer size bubbles due to the pressure change in the upstream-side bubble liquid passages β and the downstream-side bubble liquid passage γ gradually widening from the upstream side toward the downstream side relative to the liquid feeding direction. Consequently, the air bubble liquid containing air microbubbles having desired sizes can be produced.

Further, by forwardly or reversely rotating the shaft member 71 of the second air-bubble atomizer F, the interspace between the inner surface 70*f* of the side wall 70*a* and the basal end surface 71*a* of the shaft member 71 can be controlled, thereby to adjust the volume of the liquid fed to the second air-bubble atomizer F. Consequently, the desired amount of air bubble liquid can be fed to the reservoir 11.

The air bubble liquid containing sufficiently atomized air microbubbles is forwarded to the reservoir 11 through the connecting port 72*b* of the pipe joint 72 and the flow-down pipe 77.

Next, the second air-bubble atomizer in the other embodiment of the invention will be described with reference to FIG. 15 through FIG. 17.

Figure 15:
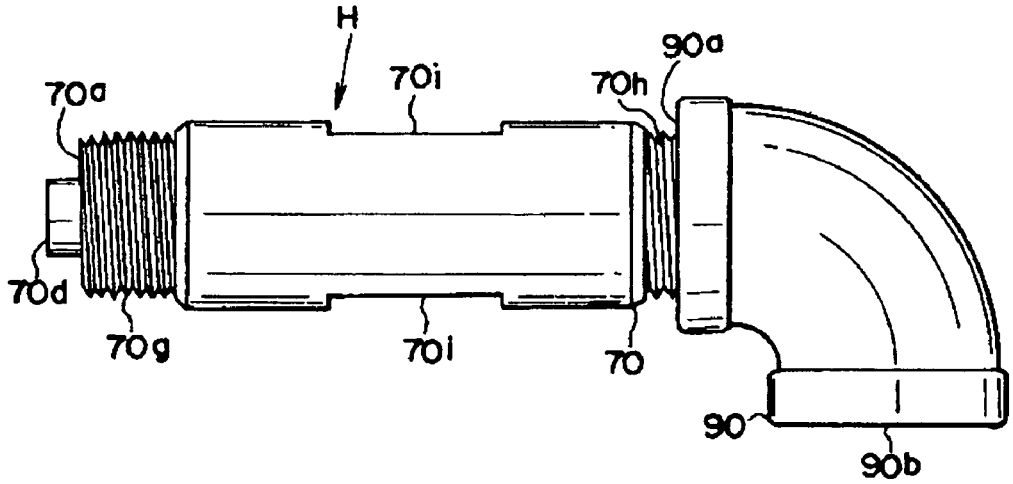
FIG. 15 Front view of the state of connecting the second air-bubble atomizer to the pipe joint in the other embodiment of the invention.
Figure 16:
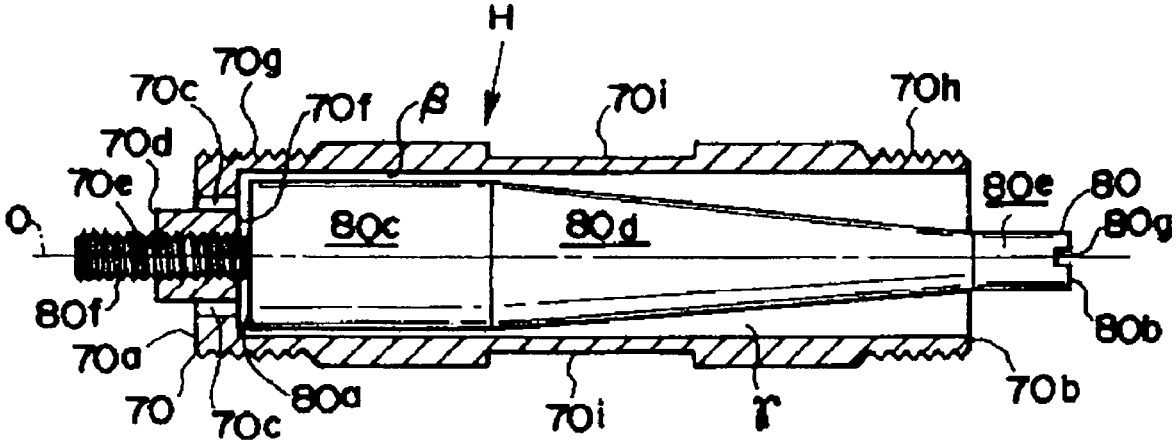
FIG. 16 Sectional view of the second air-bubble atomizer in the other embodiment of the invention.
Figure 17:
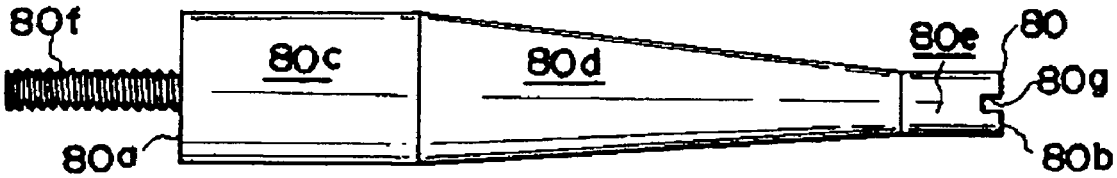
FIG. 17 Front view of the shaft member.

FIG. 15 is a front view of the state of connecting the second air-bubble atomizer to the pipe joint in the other embodiment of the invention, FIG. 16 is a sectional view of the second air-bubble atomizer in the other embodiment of the invention, and FIG. 17 is a front view of the shaft member.

In describing this embodiment, the same parts of the second air-bubble atomizer F in the aforementioned embodiment are not described for the sake of simplicity in description.

In an air-bubble atomizer H in this embodiment, a shaft member 80 is disposed coaxially within the aforementioned outer cylinder 70. That is, the shaft member 80 is secured on the outer cylinder 70 in agreement with the center axis O.

As shown in FIGS. 15-17, the shaft member 80 has a large diameter part 80*c* with a certain outer diameter over a prescribed range from the basal end surface 80*a* to the distal surface 80*b* opposite to the side wall 70*a* of the outer cylinder 70, a contractive diameter part 80*d* having a diameter tapering over a prescribed range from the large diameter part 80*c* to the distal surface 80*b*, and a small diameter part 80*d* having a diameter smaller than the aforementioned large diameter part 80*c* to the distal surface 80*b*.

The basal end surface 80*a*, i.e. the large diameter part 80*c*, has an outer diameter determined taking the opposite liquid inflow ports 70*c* into consideration. A threaded part 80*f* to be threadably fitted in the aforementioned threaded hole 70*e* protrudes outward along the center axis. In the distal surface 80*b*, there is formed a groove 80*g* into which a slotted screwdriver (not shown) is inserted.

The basal end surface 80*a* has a conically curved surface having the basal portion of the threaded part 80*f* as an apex. Even when the basal end surface 80*a* comes in contact with the side wall 70*a*, an interspace extending from the liquid inflow ports 70*c* to the upstream-side bubble liquid passage β can be ensured.

The shaft member 80 may be incorporated in a pipe joint 90 connected to the outer cylinder 70 by making the small diameter part 80*e* shorter than the aforementioned shaft member 71.

The pipe joint 90 has two connecting ports 90*a* and 90*b* opening in the different directions. The connecting ports 90*a* and 90*b* each have an inner threaded surface (not shown). The connecting port 90*a* is connected to the outer cylinder 70 in this embodiment, and the connecting port 90*b* serves as a flow-down port from which the air bubble liquid outflows.

The shaft member 80 is threadably mounted onto the side wall 70*a* of the outer cylinder 70 and therefore secured in agreement with the center axis O of the outer cylinder 70. Thus, the upstream-side and downstream-side bubble liquid passage β and γ are formed in partition forms between the inner surface of the outer periphery wall 70*e* and the outer peripheral wall of the shaft member 71, similarly to the aforementioned second air-bubble atomizer F.

It will be obvious to those skilled in the art that this invention should not be understood as being limited to the aforementioned embodiments and various changes may be made without departing from the scope of the invention as follows.

In the aforementioned embodiments, the second air-bubble atomizer is arranged at a place that is impervious to the liquid to be treated, which is stored in the reservoir, thereby to prevent adhesion of microbes ascribable to immersion into the liquid to be treated, but the invention is not to be considered limited to this structure and the second air-bubble atomizer may be arranged at a place of being immersed in the liquid to be treated.

INDUSTRIAL APPLICABILITY

This invention is applicable to treatment for separating lipids contained in waste liquid, surplus sludge treatment and so forth.

The invention claimed is:

1. An apparatus for producing a microbubble liquid containing microscopic gas bubbles, comprising:

a liquid feeding pipeline;

a pressure pump arranged on the liquid feeding pipeline for aspirating liquid from a liquid supply source and forcibly feeding the liquid by pressure;

an air bubble liquid producing means disposed on the liquid feeding pipeline on an upstream side of the pressure pump relative to a liquid feeding direction for producing the air bubble liquid by mixing the liquid with air by an aspirating pressure generated by the pressure pump;

a first air-bubble atomizer disposed on the liquid feeding pipeline on a downstream side of the air bubble liquid producing means relative to the liquid feeding direction for atomizing air bubbles contained in the air-mixed liquid produced by the air bubble liquid producing means;

a second air-bubble atomizer disposed on the liquid feeding pipeline on the downstream side of the first air-bubble atomizer relative to the liquid feeding direction for further atomizing the air bubbles atomized by the first air-bubble atomizer, wherein the first air-bubble atomizer is arranged between the air bubble liquid producing means and the pressure pump, and the second air-bubble atomizer is mounted on the liquid feeding pipeline on the downstream side in the liquid feeding direction of the pressure pump; and a pressure stabilizing tank disposed on the liquid feeding pipeline between the pressure pump and the second air-bubble atomizer.

2. The apparatus for producing microbubble liquid according to claim 1, wherein the second air-bubble atomizer includes an upstream-side bubble liquid passage having a certain cross section over a prescribed range along the liquid feeding pipeline, and a downstream-side bubble liquid passage provided on the downstream side and having a cross section gradually widening from the upstream side toward the downstream side relative to the liquid feeding direction.

3. The apparatus for producing microbubble liquid according to claim 1, wherein the second air-bubble atomizer includes an upstream-side bubble liquid passage having a certain cross section over a prescribed range along the liquid feeding pipeline, a downstream-side bubble liquid passage provided on the downstream side and having a cross section gradually widening from the upstream side toward the downstream side relative to the liquid feeding direction, and a liquid volume adjusting mechanism for controlling the air bubble liquid in volume fed into the upstream-side bubble liquid passage so as to enable production of a desired amount of air bubble liquid.

4. The apparatus for producing microbubble liquid according to claim 1, wherein the second air-bubble atomizer includes an upstream-side bubble liquid passage having a certain cross section over a prescribed range along the liquid feeding pipeline, the upstream-side bubble liquid passage being formed inside an outer cylinder having a partition wall in which a liquid inflow port is bored on the upstream side relative to the liquid feeding direction and an outlet port opening on the downstream-side relative to the liquid feeding direction, and a downstream-side bubble liquid passage provided continuously on the downstream side of the upstream-side bubble liquid passage and having a cross section gradually widening from the upstream side toward the downstream side relative to the liquid feeding direction.

5. The apparatus for producing microbubble liquid according to claim 1, wherein the second air-bubble atomizer includes an upstream-side bubble liquid passage having a certain cross section over a prescribed range along the liquid feeding pipeline, a downstream-side bubble liquid passage provided continuously on the downstream side of the upstream-side bubble liquid passage and having a cross section gradually widening from the upstream side toward the downstream side relative to the liquid feeding direction, and a liquid volume adjusting mechanism for controlling the air bubble liquid in volume fed into the upstream-side bubble liquid passage.

6. The apparatus for producing microbubble liquid according to claim 1, wherein the second air-bubble atomizer includes a shaft member having a large diameter part with a certain outer diameter over a prescribed range along the liquid feeding direction so as to form an upstream-side bubble liquid passage in a partition form having a certain cross section over a prescribed range along the liquid feeding pipeline, and a contractive diameter part having a diameter tapering toward the downstream side relative to the liquid feeding direction so as to form a downstream-side bubble liquid passage provided on the downstream side and having a cross section gradually widening from the upstream side toward the downstream side relative to the liquid feeding direction, the shaft member being arranged coaxially with an outer cylinder having a constant inner diameter.

7. The apparatus for producing microbubble liquid according to claim 1, wherein the second air-bubble atomizer includes a shaft member having a large diameter part with a certain outer diameter over a prescribed range along the liquid feeding direction so as to form an upstream-side bubble liquid passage in a partition form having a certain cross section over a prescribed range along the liquid feeding pipeline, and a contractive diameter part having a diameter tapering toward the downstream side relative to the liquid feeding direction so as to form a downstream-side bubble liquid passage provided on the downstream side and having a cross section gradually widening from the upstream side toward the downstream side relative to the liquid feeding direction, the shaft member being arranged coaxially with an outer cylinder having a constant inner diameter, and a liquid volume adjusting mechanism for controlling the air bubble liquid in volume fed into the upstream-side bubble liquid passage.

8. The apparatus for producing microbubble liquid according to claim 1, wherein the first air-bubble atomizer includes a bubble liquid passage provided on the downstream side and having a cross section gradually widening from the upstream side toward the downstream side relative to the liquid feeding direction.

9. The apparatus for producing microbubble liquid according to claim 1, wherein the first air-bubble atomizer includes a bubble liquid passage having a cross section gradually widening from the upstream side toward the downstream side relative to the liquid feeding direction, the bubble liquid passage being formed inside an outer cylinder having a partition wall in which a liquid inflow port is bored on the upstream side relative to the liquid feeding direction and an outlet port opening on the downstream-side relative to the liquid feeding direction.

10. The apparatus for producing microbubble liquid according to claim 1, wherein the first air-bubble atomizer includes a shaft member having a diameter tapering from the upstream side toward the downstream side relative to the liquid feeding direction so as to form a bubble liquid passage in a partition form having a cross section gradually widening from the upstream side toward the downstream side relative to the liquid feeding direction, the shaft member being arranged coaxially with an outer cylinder having a constant inner diameter.

11. The apparatus for producing microbubble liquid according to claim 1, wherein liquid to be treated is stored in a reservoir for feeding the air bubble liquid from the second air-bubble atomizer, and the second air-bubble atomizer is arranged at a place that is impervious to the liquid to be treated, which is stored in the reservoir.

12. The apparatus for producing microbubble liquid according to claim 1, wherein liquid to be treated is stored in a reservoir for feeding the air bubble liquid from the second air-bubble atomizer, and the second air-bubble atomizer is arranged so as to be immersed in the liquid to be treated, which is stored in the reservoir.

* * * * *